United States Patent [19]

Henne et al.

[11] Patent Number: 4,598,872

[45] Date of Patent: Jul. 8, 1986

[54] METHOD OF OPERATING GRINDING APPARATUS AND GRINDING APPARATUS OPERATING ACCORDING TO THIS METHOD

[75] Inventors: Heinrich Henne, Ennigerloh; Ludger Lohnherr, Oelde; Peter Rittscher; Walter Holz, both of Beckum, all of Fed. Rep. of Germany

[73] Assignee: Krupp Polysius AG, Beckum, Fed. Rep. of Germany

[21] Appl. No.: 730,934

[22] Filed: May 6, 1985

[30] Foreign Application Priority Data

May 16, 1984 [DE] Fed. Rep. of Germany ..... 3418196

[51] Int. Cl.[4] ..... B02C 15/00; B02C 25/00

[52] U.S. Cl. ..... 241/19; 241/34; 241/119

[58] Field of Search ..... 241/117, 118, 30, 119, 241/120, 19, 121, 80, 97, 33, 34, 35

[56] References Cited

U.S. PATENT DOCUMENTS 3,951,347 4/1976 Tiggesbaumker et al. ..... 241/80 X

FOREIGN PATENT DOCUMENTS 548852 4/1932 Fed. Rep. of Germany ..... 241/119

*Primary Examiner*—Mark Rosenbaum

*Attorney, Agent, or Firm*—Learman & McCulloch

[57] ABSTRACT

The invention relates to grinding apparatus and a method of operating such apparatus in which the gas speed in the nozzle ring of the mill is altered as a function of the power consumption of the bucket conveyor so that the quantity of material conveyed by the bucket conveyor and the gradation of grain sizes thereof are kept constant. A control circuit alters the material supply to the mill when the gas speed in the nozzle ring exceeds a predetermined maximum value or falls below a predetermined minimum value.

16 Claims, 6 Drawing Figures

METHOD OF OPERATING GRINDING APPARATUS AND GRINDING APPARATUS OPERATING ACCORDING TO THIS METHOD

The invention relates to the grinding of material in a roller mill.

During operation of a roller mill of the type to which the invention relates the quantity of hot gas passing through the mill and the sifter is kept constant by a control circuit, and a constant gas speed is also set in the nozzle ring of the mill. However, because of dynamic processes within the grinding system the quantity of material falling downwards through the nozzle ring and conveyed upwards again by the bucket conveyor and the grain size distribution of the said material fluctuate even when the gas speed is constant in the nozzle ring. This variation in the quantity and the grain size distribution of the material in circulation is inconvenient since in the production of special products or for example in the grinding of cement it is often desired to keep the quantity and grain size distribution of the material in circulation constant, for instance in order to extract a specific range of grain sizes from the material in circulation.

The object of the invention, therefore, is to provide a method and apparatus wherein the quantity and the gradation of grain sizes of the material conveyed by the bucket conveyor (i.e. the material in circulation) is kept constant and at the same time possible disruption of operation (such as the mill filling up or running empty) is avoided.

Figure 1:
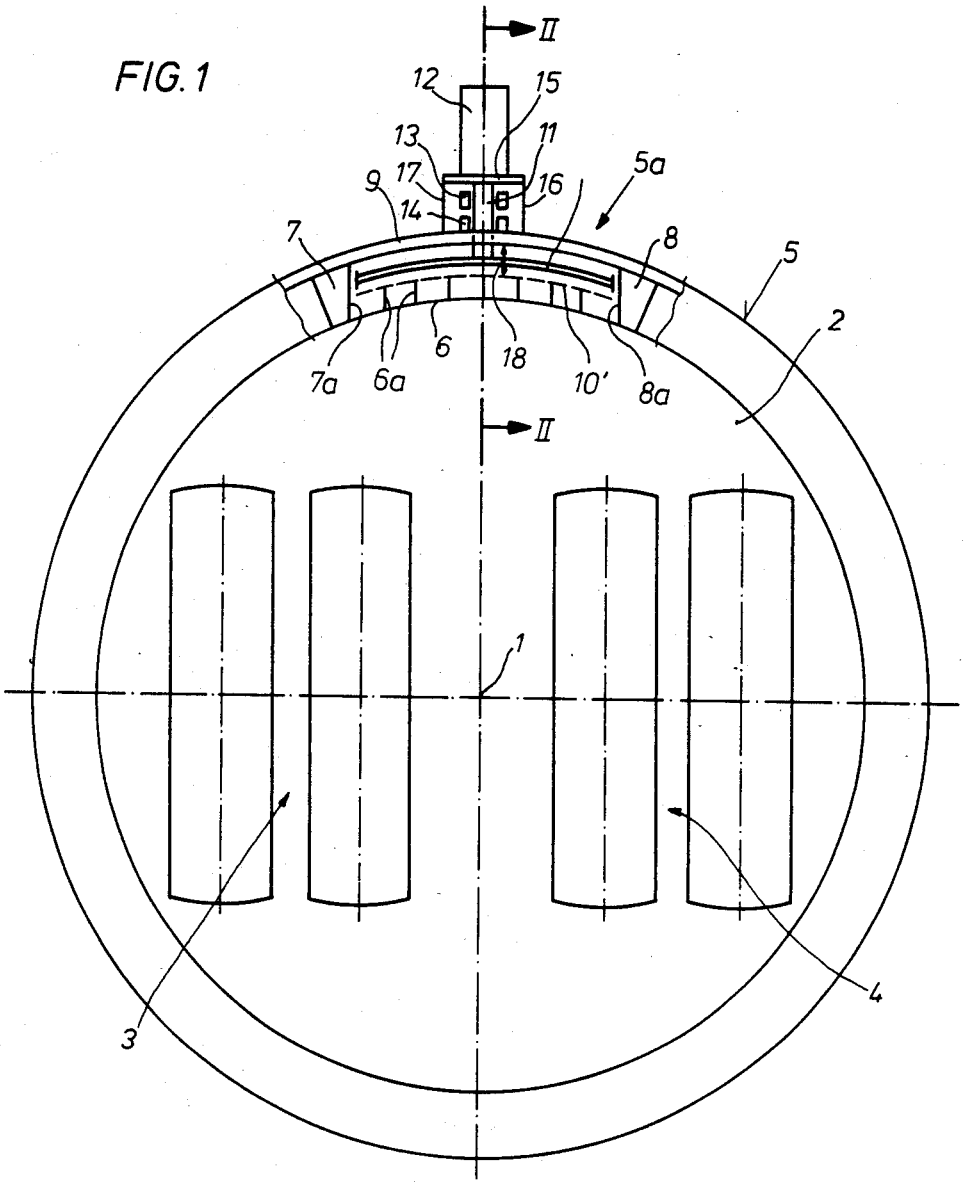
Figure 2:
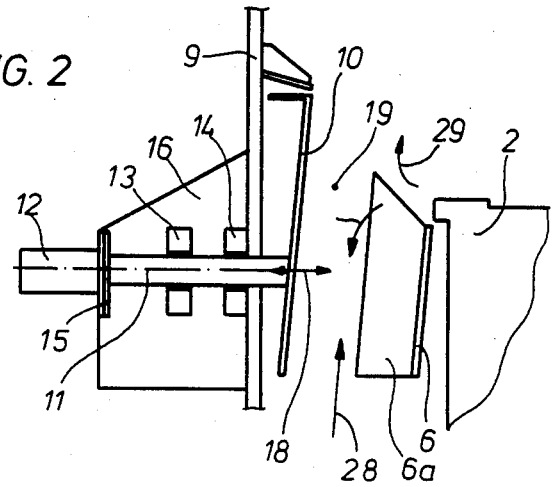
Figure 3:
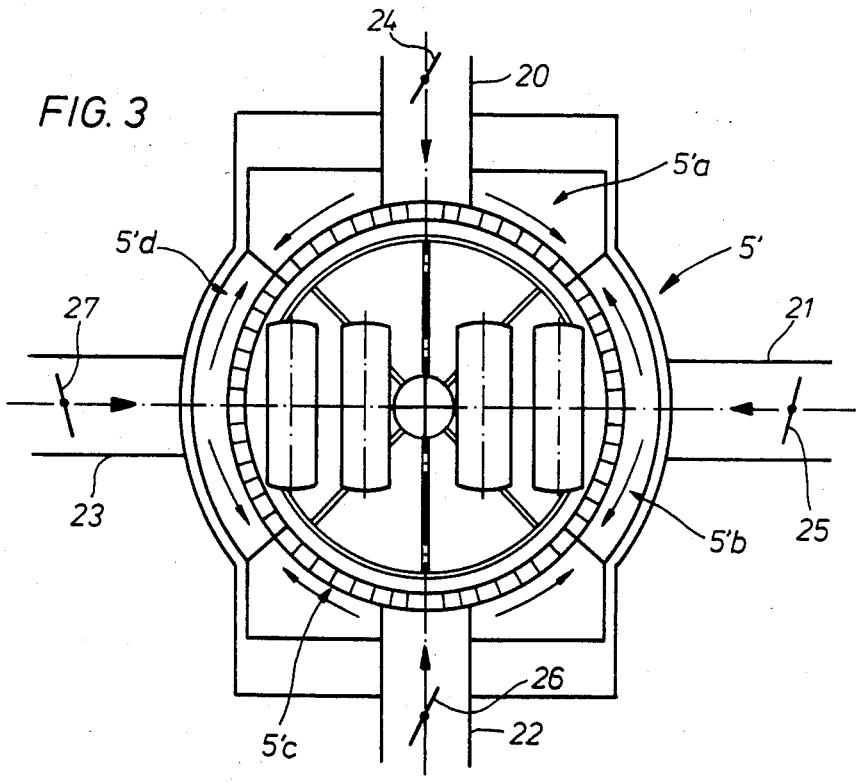
Figure 4:
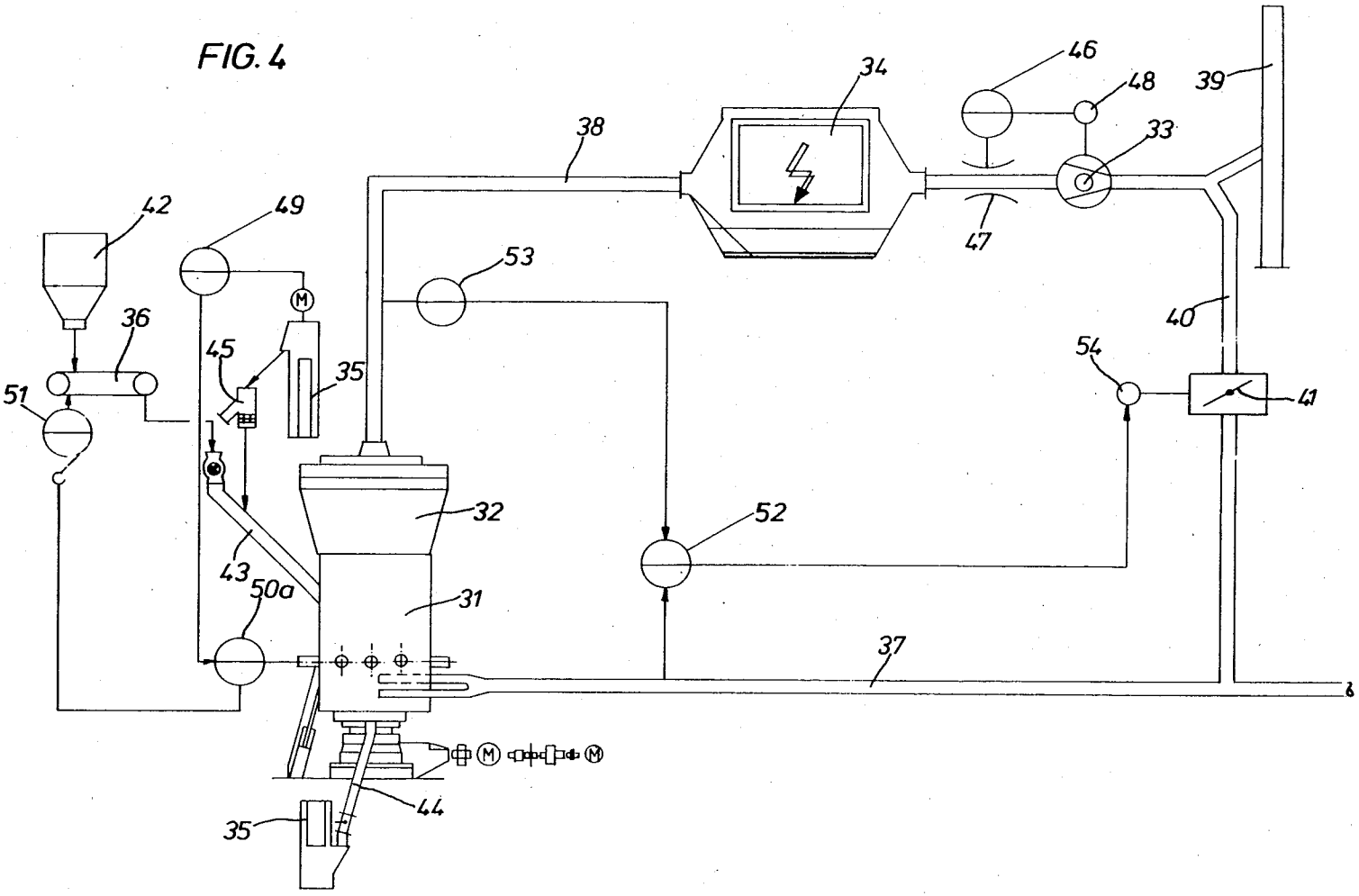
Figure 5:
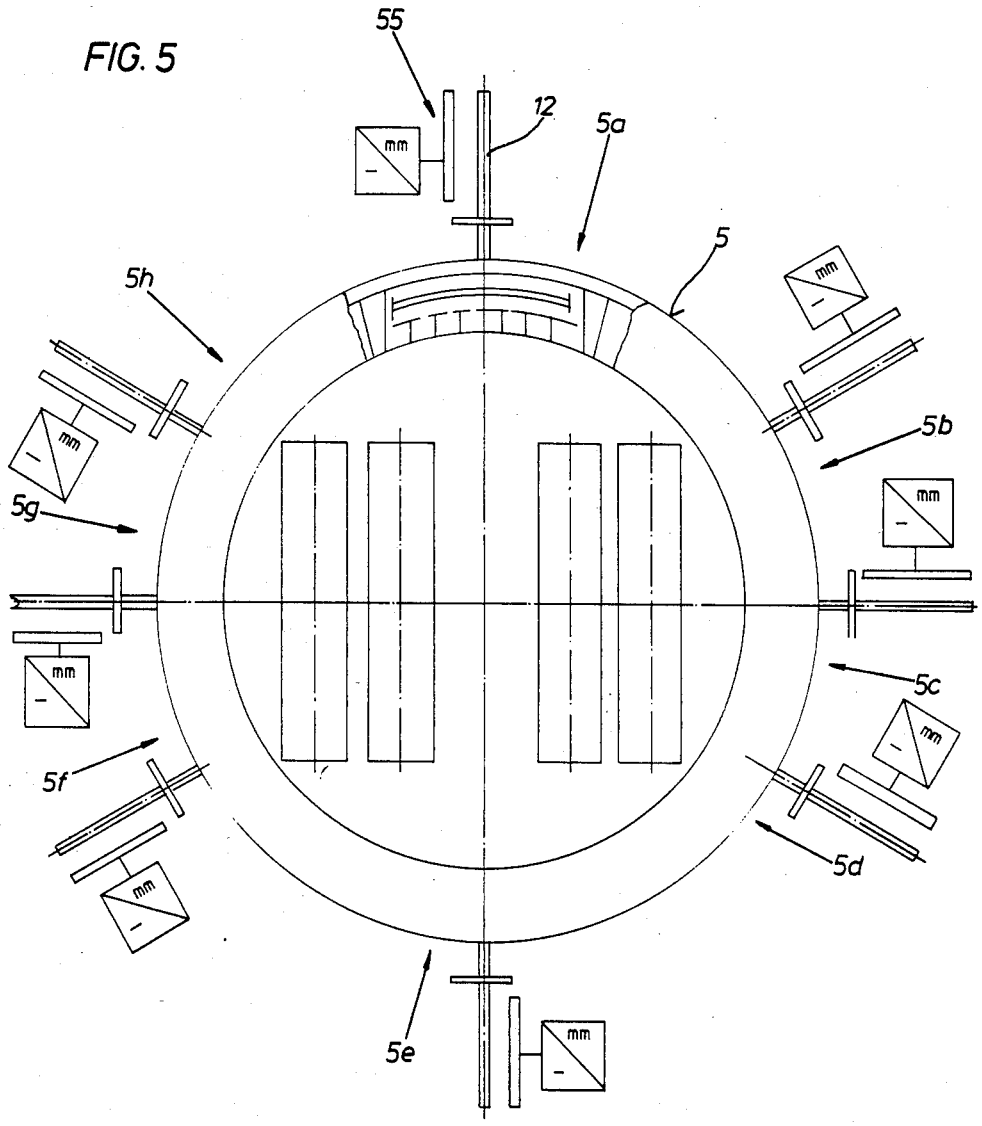
Figure 6:
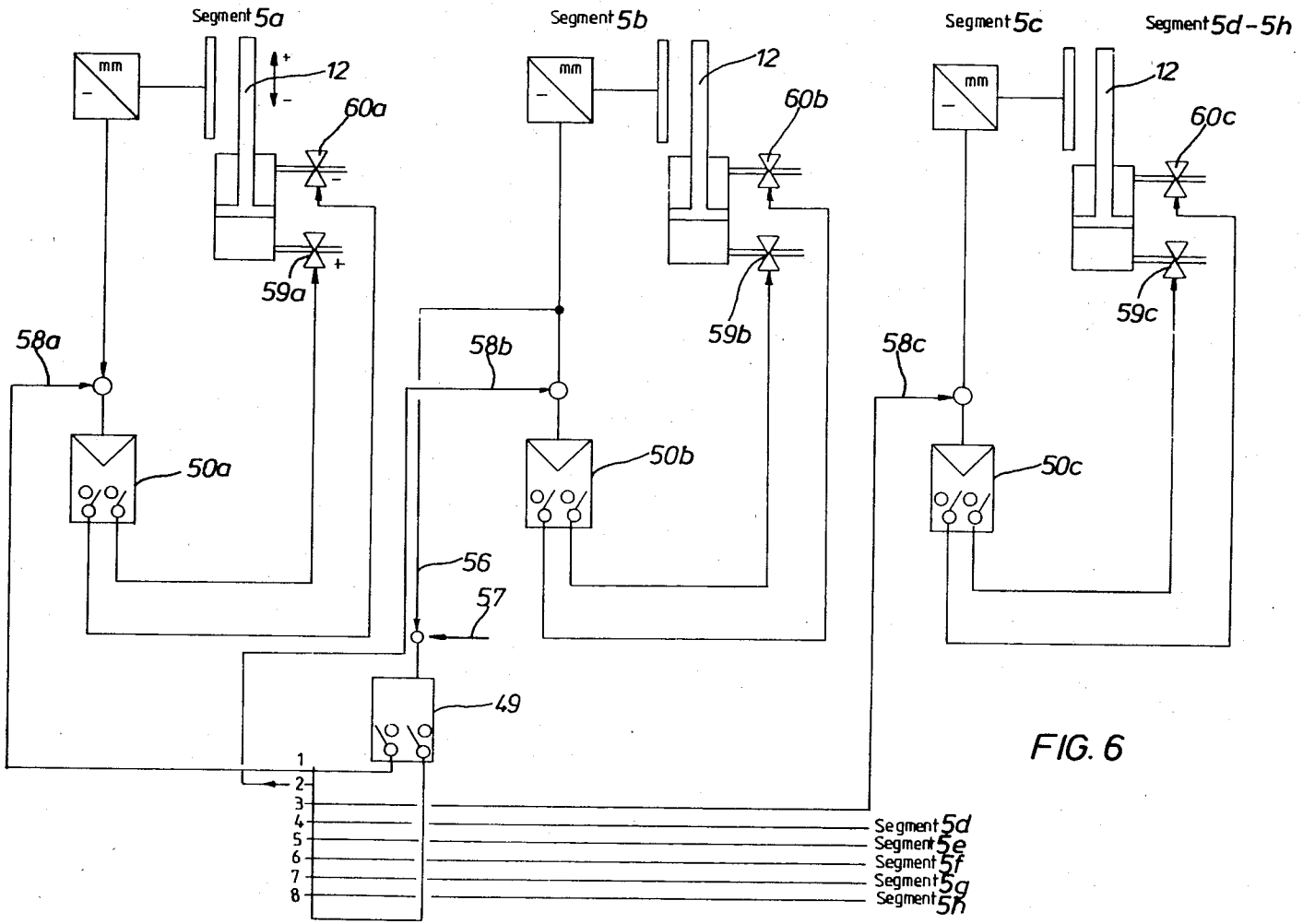

Advantageous embodiments of the invention are explained in greater detail in connection with the accompanying drawings, wherein:

FIG. 1 shows a plan view of the parts of a roller mill which are essential for understanding the invention, FIG. 2 shows a section along the line II—II in FIG. 1, FIG. 3 shows a schematic plan view of a second embodiment of a roller mill according to the invention, FIG. 4 shows a schematic representation of grinding apparatus operated by the method according to the invention, FIG. 5 shows a plan view of a roller mill with separately adjustable segments of the nozzle ring, FIG. 6 shows a diagram of the control circuit for the adjustment of the invention segments of the nozzle ring.

The roller mill shown schematically in FIGS. 1 and 2 comprises a circular grinding plate 2 which rotates about a vertical axis 1 and on which two pairs of rollers 3, 4 roll.

A stationary nozzle ring 5 is arranged on the outer periphery of the grinding plate 2 and serves to supply an air stream which picks up the fine constituents of the comminuted material for grinding discharged over the edge of the grinding plate and carries them upwards, whilst the coarse constituents fall downwards through the nozzle ring 5 against the air stream.

The nozzle ring 5 is divided into a plurality of segments of which the segment 5*a* is shown in detail in FIG. 1.

The segment 5*a* of the nozzle ring 5 contains an inner stationary wall part 6 which is connected to the housing 9 of the mill by two lateral guide parts 7, 8. The stationary inner wall part 6 supports a plurality of crosspieces 6*a* which are directed outwards.

The segment 5*a* of the nozzle ring 5 also contains an outer adjustable wall part 10 which is connected to the thrust spindle 11 of a pneumatic cylinder 12. The thrust spindle 11 is radially guided in sliding guides 13, 14. The pneumatic cylinder 12 is supported by a flange 15 which is mounted by means of struts 16, 17 on the housing 9.

The outer wall parts 10 of the segment 5*a* of the nozzle ring 5 can be adjusted in the radial direction (double arrow 18) by means of the spindle 11 of the pneumatic cylinder 12 between a radially outer position in which the wall part 10 is located near the housing 9 and a position 10′ shown by broken lines in which the adjustable wall part 10 touches the struts 6*a* of the stationary inner wall part 6 and in which it causes the internal cross-section of the interior 19 of the segment 5*a* through which air flows to be limited to a minimum.

The adjustable wall part 10 of the segment 5*a* is guided in the region of the ends facing the adjacent segments on parallel guide surfaces 7*a*, 8*a* of the guide parts 7, 8. In addition a connecting link guide can be provided in the region of these guide surfaces 7*a*, 8*a* in order to exclude the danger of tilting of the adjustable outer wall part 10 relative to a horizontal plane.

Whereas in the embodiment shown in FIGS. 1 and 2 the outer wall parts 10 of the individual segments of the nozzle ring 5 are adjustable by means of pneumatic cylinders 12, adjustment by an electric of hydraulic drive can be provided within the scope of the invention.

The number of segments of the nozzle ring 5 which are in each case provided with a separate drive, are ventilated and adjustable is adapted to the particular application. In addition the nozzle ring can contain individual unventilated segments alternating with ventilated and adjustable segments. A construction is for example conceivable with eight ventilated adjustable segments and four unventilated segments arranged between them.

FIG. 3 shows in schematic form an embodiment in which four air supplies 20, 21, 22, 23 are provided with which separately adjustable segments 5′*a*, 5′*b*, 5′*c* and 5′*d* are associated. These four segments 5′*a* to 5′*d* of the nozzle ring 5′, details of which are not shown in FIG. 3, have—like the embodiment of FIGS. 1 and 2—a wall which can be adjusted from outside during operation for limiting the internal cross-section of the nozzle ring and, by being adjusted, can alter the flow conditions for air in the region of the relevant segment. The means for adjusting the nozzle ring cross-section are also not shown in FIG. 3, but may be like that of the earlier described embodiment.

Regulating valves 24 to 27 which permit a more or less strong throttling of the air streams supplied are provided in the air supplies 20 to 23. The air supplied through the air supplies 20 to 23 is distributed in the manner indicated schematically by the arrows onto the peripheral length of the segments 5′*a* to 5′*d* of the nozzle ring 5′. In the embodiment according to FIG. 3 the peripheral zones of the grinding plate associated with the individual segments 5′*a* to 5′*d* of the nozzle ring 5′ can be ventilated differentially (as regards the flow quantities and flow speeds), which because of the differing material yield in the individual zones facilitates optimisation of the pneumatic material discharge.

As in the embodiment according to FIGS. 1 and 2, in the embodiment according to FIG. 3 the air also flows essentially upwards through the nozzle ring 5′. In FIG. 2 the air flowing through the nozzle ring 5 is indicated by the arrow 28. The fine constituents of the comminuted material discharged over the edge of the grinding plate 2 are carried upwards with it—arrow 29—whilst the coarse constituents of the material for grinding fall downwards against the air stream.

FIG. 4 shows the layout of grinding apparatus operating by the method according to the invention.

This grinding apparatus contains a ring or roller mill 31, a sifter 32 arranged above the mill 31, a blower 33, an electrostatic filter 34, a bucket conveyor 35 and a dosaging conveyor-type weigher 36.

The blower 33 produces a hot gas stream which is delivered to the mill 31 via a pipe 37 which passes through the mill with the nozzle ring 5 already described above, then flows through the sifter 32 and is extracted via pipe 38 and the electrostatic filter 34 into a chimney 39. A return air pipe 40 with a valve 41 arranged therein facilitates the return of an adjustable proportion of the gas stream from the pipe 38 into the pipe 37.

The material to be ground is delivered from a silo 42 via the dosaging conveyor-type weigher 36 and a material pipe 43 to the mill 31. The fine constituents of the comminuted material for grinding discharged over the edge of the grinding plate 2 are picked up by the gas stream and conveyed upwards to the sifter 32 where the finished material is precipitated.

The coarse constituents of the comminuted material for grinding discharged over the edge of the grinding plate fall downwards through the nozzle ring 5 and pass via a material pipe 44 to the bucket conveyor 35 which conveys them upwards to a screening or distributing arrangement 45. Here a specific proportion, for example a specific grain size fraction of the material in circulation can be extracted, whilst the rest of the circulating material is led back to the mill 31 via the material pipe 43.

The apparatus according to FIG. 4 contains a first control circuit which keeps the quantity of the hot gas stream passing through the mill 31 and the sifter 32 constant. A regulator 46 forming part of this first control circuit receives from a Venturi tube 47 in the pipe 38 a signal relating to the quantity of gas passing through the pipe 38 and regulates the blower 33 by means of a motor 48 with a view to keeping the quantity of gas constant.

The apparatus also contains a second control circuit by means of which the gas speed in the nozzle ring 5 is altered as a function of the power consumption of the bucket conveyor 35 so that the quantity of material conveyed by the bucket conveyor 35 and the gradation of grain sizes thereof are kept constant. This second control circuit contains a master regulator 49 and subsequent regulators 50*a*, 50*b*, 50*c* etc. which co-operate as will be explained in detail with the aid of FIG. 6.

A third control circuit is also provided which reduces the material supply to the mill 31 when the gas speed in the nozzle ring 5 exceeds a predetermined maximum value, whereas it increases the material supply when the gas speed in the nozzle ring 5 falls below a predetermined minimum value. This third control circuit contains a regulator 51 which is connected to one or more of the subsequent regulators 50, 50*b*, 50*c* and acts on the dosaging conveyor-type weigher 36.

Finally, a fourth control circuit is also provided which regulates the temperature of the hot gas stream passing through the mill 31 and the sifter 32 in such a way that the gas temperature after the sifter 32 is used as a command variable for the theoretical value for the gas temperature before the mill 31. This fourth control circuit contains a regulator 52 to which the gas temperature after the sifter 32 is supplied by a temperature measuring element 53 as a command variable for the theoretical value for the gas temperature before the mill 31. The appropriate gas temperature before the mill 31 is set by means of a motor 54 which acts on the valve 41 arranged in the return air pipe 40. Naturally, in place of this a fresh air valve (not shown) can also be adjusted.

In normal operation the quantity of material conveyed by the bucket conveyor 35 and the gradation of grain sizes thereof are kept constant by the second control circuit. If the quantity of coarse constituents of the comminuted material for grinding discharged over the edge of the grinding plate falling downwards through the nozzle ring against the gas stream increases and if as a consequence thereof the power consumption of the bucket conveyor 35 increases, then the regulator 49 increases the gas speed in the nozzle ring 5 by appropriate reduction of the internal cross-section of the nozzle ring. Correspondingly, in the case of a reduction in the power consumption of the bucket conveyor 38 the gas speed in the nozzle ring 5 is reduced.

However, in order to prevent the mill from filling up or running empty in the event of a significant alteration in the grindability of the material the third control circuit comes into operation when the gas speed in the nozzle ring 5 exceeds a predetermined maximum value or falls below a predetermined minimum value. In the first case (if the mill threatens to fill up) the material supply to the mill 31 is reduced by the regulator 51 via the dosaging conveyor-type weigher 36, in the second case (if the mill threatens to run empty) the material supply to the mill is increased. FIG. 5 shows the arrangements for altering the internal cross-section of the nozzle ring 5 which is divided into a plurality of separately adjustable segments 5*a* to 5*h*. Hydraulic or pneumatic cylinders 12 which are described in detail with the aid of FIGS. 1 to 3 serve for the adjustment. Non-contact displacement pickups 55 are provided for determining the free cross-sectional surface of the nozzle ring 5 in the individual segments 5*a* to 5*h*.

The co-operation of the master regulator 49 and the subsequent regulators 50*a*, 50*b*, 50*c* . . . associated with the individual segments 5*a*, 5*b*, 5*c* . . . is shown in FIG. 6. The master regulator 49 receives an actual value (arrow 56) for the current internal cross-section of the nozzle ring 5 from a selected segment (for example from the segment 5*b*). The regulator 49 receives the theoretical value (arrow 57) as a function of the power consumption of the bucket conveyor 35. The signal (arrows 58*a*, 58*b*, 58*c* . . .) formed by the master regulator 49 is then supplied as theoretical value to the subsequent regulators 50*a*, 50*b*, 50*c* . . . which actuate hydraulically releasable shut-off valves 59*a*, 60*a*, 59*b*, 60*b*, 59*c*, 60*c* . . . of the cylinders 12 of the individual segments 5*a* to 5*h*.

The normal positions of the individual segments can be set differently, i.e. associated with a differing internal cross-sectional side of the nozzle ring in the region of the individual segments, so that in the individual peripheral regions of the nozzle ring 5 different quantities of gas (corresponding to the different material load in these peripheral regions) can be set.

We claim:

1. In a method of grinding wherein material to be ground is delivered to a ring mill having a circular grinding plate which rotates about a vertical axis and cooperates with grinding elements, a stationary nozzle ring on the outer periphery of the grinding plate, a sifter above the mill, a blower for delivering a gas stream through the nozzle ring into said mill and the sifter at a speed to entrain relatively fine constituents of ground material discharged over the periphery of the grinding plate and carry them upwards towards the sifter, a power driven conveyor for receiving the relatively coarse constituents of the ground material discharged over the periphery of the grinding plate and conveying such constituents upwards for return to said ring mill, and wherein the quantity of the hot gas stream passing through the mill and the sifter is kept substantially constant by a first control circuit, the improvement comprising sensing the consumption of power by said conveyor, altering the gas speed in the nozzle ring in response to a change in the consumption of power by said conveyor in a manner to maintain the quantity of material and the gradation of grain sizes thereof conveyed by said conveyor substantially constant, sensing the speed of gas passing through said nozzle ring, and reducing and increasing the delivery of material to said mill in response to a predetermined increase and decrease, respectively, of the speed of the gas passing through said nozzle ring.

2. The method according to claim 1 including sensing the temperature of the gas stream passing through the mill and the sifter and adjusting the quantity of gas supplied to said nozzle ring to maintain said temperature substantially constant.

3. The method according to claim 1 wherein the gas speed in the nozzle ring is altered by adjustment of the cross-section of the nozzle ring.

4. The method according to claim 1 including altering independently the speed of gas passing through different arcuate segments of said nozzle ring.

5. In ring mill grinding apparatus having an inlet for material to be ground, means for supplying said inlet with material to be ground, a circular grinding plate in communication with said inlet and rotatable about a vertical axis in grinding engagement with rotary grinding elements, a stationary nozzle ring at the outer periphery of the grinding plate, a sifter above the grinding plate, a blower for passing a gas stream through the nozzle ring to entrain relatively fine constituents of ground material discharged over the periphery of the grinding plate and carry them upwards towards the sifter, a power driven conveyor for receiving relatively coarse constituents of ground material discharged over the periphery of the grinding plate and returning such constituents to said inlet, and a first control means for maintaining the quantity of gas passing through the mill and the sifter substantially constant, the improvement comprising means for sensing the consumption of power by said conveyor, means for varying the speed of gas passing through said nozzle ring, second control means for altering the speed of gas passing through the nozzle ring in response to a change in the power consumption of the conveyor and in such manner as to maintain the quantity and gradation of grain sizes of material on said conveyor substantially constant, means for sensing the speed of gas passing through said nozzle ring, and means for reducing and increasing the material supplied to said mill in response to a predetermined increase and decrease, respectively, of the speed of gas passing through said nozzle ring.

6. Apparatus according to claim 5 wherein said nozzle ring has at least one wall the position of which limits the internal cross-section of the nozzle ring, and means for adjusting the position of said wall.

7. Apparatus according to claim 6 wherein the means for adjusting said wall is operable from externally of said mill and during operation thereof.

8. Apparatus according to claim 5 wherein the nozzle ring is composed of a plurality of separate segments.

9. Apparatus according to claim 8 including a number of air supplies corresponding to and communicating with the segments of said nozzle ring.

10. Apparatus according to claim 8 wherein each of said segments has a movable wall which limits the internal cross-section of such segment, and including means for adjusting each of said movable walls independently of the remainder thereof.

11. Apparatus according to claim 10 wherein said adjusting means comprises a hydraulic drive.

12. Apparatus according to claim 10 wherein said adjusting means comprises an electric drive.

13. Apparatus according to claim 10 wherein said adjusting means comprises a pneumatic drive.

14. Apparatus according to claim 8 including stationary guides having parallel guide surfaces at the opposite ends of each of said segments.

15. Apparatus according to claim 5 wherein said nozzle ring is composed of a number of individual segments a selected number of which have passages through which said gas passes.

16. Apparatus according to claim 15 including noncontact displacement pickups for determining the positions of the individual segments.

* * * * *